US005419045A

United States Patent [19]

Magdich

[11] Patent Number: 5,419,045

[45] Date of Patent: May 30, 1995

[54] HAND CUTTING TOOL FOR PREPARING CAULKING GUN CARTRIDGE NOZZLES

[76] Inventor: George A. Magdich, 134 High St., Imperial, Pa. 15126

[21] Appl. No.: 250,494

[22] Filed: May 27, 1994

[51] Int. Cl.[6] ..... B25F 1/00

[52] U.S. Cl. ..... 30/145; 30/229

[58] Field of Search ..... 30/178, 179, 229, 258, 30/278, 279.2, 286, 289, 293, 123, 131, 145, 146

[56] References Cited

U.S. PATENT DOCUMENTS

| | | | |
|---|---|---|---|
| 270,967 | 1/1883 | Merriam | 30/229 |
| 573,110 | 12/1896 | Shannon | 30/178 |
| 1,667,985 | 5/1928 | Purnell | 30/229 |
| 1,978,124 | 10/1934 | Batchler | 30/145 |
| 2,224,226 | 12/1936 | Jensen | 30/229 |
| 2,556,819 | 6/1951 | Musselwhite et al. | 30/229 |
| 2,582,736 | 1/1952 | Altieri | 30/178 |
| 2,589,891 | 3/1952 | Stone | 30/229 |
| 2,595,841 | 5/1952 | Click et al. | 30/229 |
| 2,612,686 | 4/1955 | Wagner | 30/178 |
| 2,751,681 | 6/1956 | Hillson | 30/229 |
| 4,102,045 | 7/1978 | Bergh | 30/287 |
| 4,106,195 | 8/1978 | Berg | 30/293 |
| 5,046,252 | 9/1991 | Ayuta et al. | 30/258 |

*Primary Examiner*—Hwei Siu Payer
*Attorney, Agent, or Firm*—Carothers & Carothers

[57] ABSTRACT

A hand tool for cutting plastic caulking gun cartridge nozzles in preparation for laying a uniform bead of caulk wherein a slicing blade mechanism is provided between the handles of the plier like implement to cut off the caulking tube tip and a V-shaped cutting device is provided in the jaws of the plier like tool to cut a V-shaped notch in the open end of the cartridge nozzle tube tip. The slicing blade is shielded for safety considerations.

3 Claims, 2 Drawing Sheets

HAND CUTTING TOOL FOR PREPARING CAULKING GUN CARTRIDGE NOZZLES

BACKGROUND OF THE INVENTION

This invention relates to a hand tool for cutting plastic nozzle tubes on conventional caulking gun cartridges in preparation for laying a uniform bead of caulking.

In the automobile glass industry, the original equipment manufacturing standards require a minimum bead of urethane caulking to be ¼" when installing windshields and other stationary glass in motor vehicles. It is very important that these standards are met to insure that the glass will stay bonded to the vehicle before, during and after a collision.

In addition, the installation must be leak free and there must be no inclusion of air bubbles in the caulking bead laid.

Plastic caulking nozzle tubes on caulking cartridges are usually cut with a knife or a razor, which of course can prove to be hazardous.

It is a principal object of the present invention to provide a hand tool for not only cutting off the tip of the cartridge nozzle tube easily and in a safe manner, but to also provide an additional special V cut on the tip of the open ended nozzle tube which enables the installer to lay a perfect bead of ¼" or larger, as desired.

SUMMARY OF THE INVENTION

The hand tool of the present invention for cutting plastic caulking gun cartridge nozzles, in preparation for laying a uniform bead of caulk, consists of a plier like implement which includes a pair of coaxial pivotally connected and coacting handles which also have coacting die carrying jaws extending beyond this pivotal connection.

One of the jaws is provided with a base plate providing an anvil. This anvil plate, in combination with the jaw to which it is attached, is adapted in size and shape to be readily inserted into the open end of a caulking nozzle tube after the tip has been cut off such that the cartridge nozzle tube is internally supported by the anvil for cutting.

The other jaw is provided with a V-shaped cutting blade which coacts with the anvil for cutting the nozzle tube when disposed on the anvil to form a V-shaped notch in the end of the cut tube. The apex of this V notch is directed away from the nozzle tube open end and the base of the notch coincides with the open end of the nozzle tube. This special V notch arrangement permits the caulker to lay a very uniform bead of caulk on a windshield or on any other product.

The handles of the cutting tool are additionally provided with a shear for cutting off the caulking gun cartridge nozzle tube tip to provide the open end. This shear preferably includes a cutting blade that protrudes with a distal cutting edge from one handle toward the other handle, and a closely spaced parallel pair of guide blades protrude from the other handle toward the first mentioned handle with the cutting blade edge disposed between these guide blades so that the cutting edge is shielded for safety purposes.

A pair of aligned transverse openings are provided through these parallel guide blades and are adapted when the handles are open for receiving a nozzle tube tip therethrough. The cutting blade may then be actuated by squeezing the handles together to sever the tube tip.

The diameter of the aligned openings may be set so that the tapered nozzle will fully plug the opening when fully inserted therein to thereby regulate the diameter of the open end of the tube when the nozzle tip is cut off.

The V-shaped cutting blade is also preferably made to be replaceable so that when the blade becomes dull it may be changed.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention, wherein:

DETAILED DESCRIPTION OF THE PREFERRED EMBODIMENT

Figure 1:
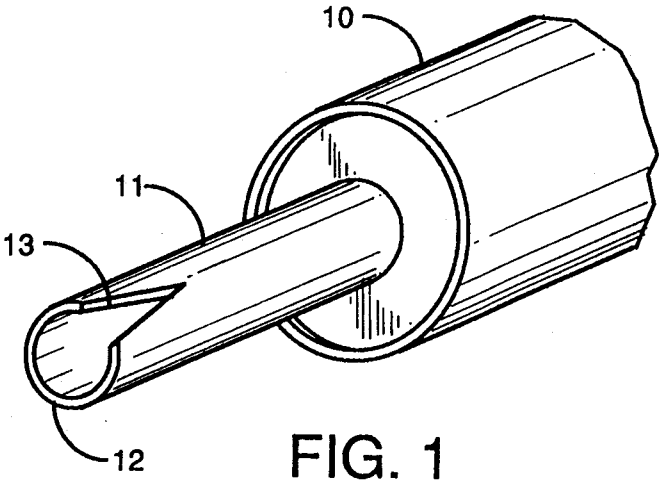
FIG. 1 is a perspective view with portions removed showing the forward end of a conventional caulking cartridge tube with the nozzle tip cut off in a special configuration by the hand tool of the present invention.
Figure 2:
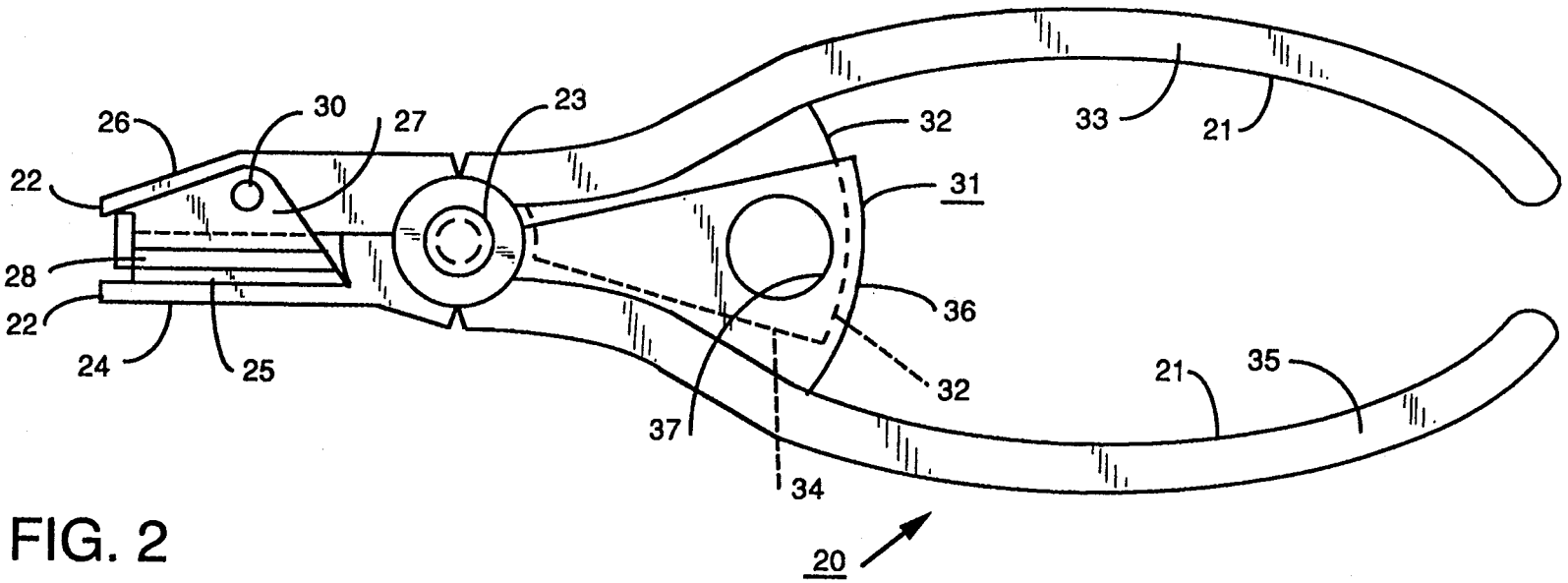
FIG. 2 is a view in side elevation of the hand tool of the present invention showing the handles and jaws in the closed position.
Figure 4:
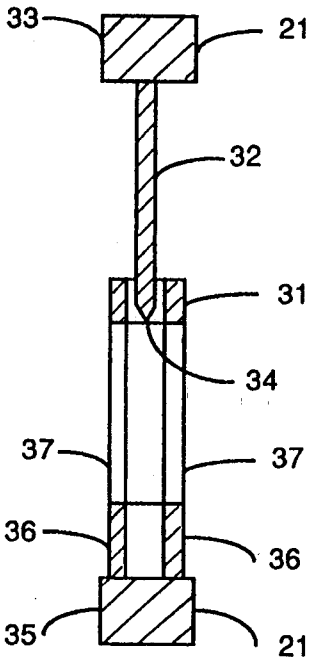
FIG. 4 is a view in cross section along section line IV—IV of FIG. 3.

Referring to FIG. 1, the forward end of a conventional caulking gun cartridge 10 is illustrated with the cartridge nozzle robe 11 protruding therefrom.

The forward end 12 of the nozzle tube 11 is illustrated with a special V cut 13. The cutoff open end 12 of the nozzle and the special V cut 13 are both safely, and easily provided by the hand tool of the present invention described hereinafter with reference to FIGS. 2 through 6.

The hand tool 20 of the present invention for cutting caulking gun cartridge nozzles as illustrated in FIG. 1, in preparation for laying a uniform bead of caulk generally consists of a plier like implement, includes a pair of coaxial pivotally connected and coacting handles 21 having coacting dye carrying jaws 22 extending beyond the pivotal connection 23 of the handles 21.

The lower jaw 24 is provided with a base plate 25 which acts a cutting anvil. The anvil plate 25 is adapted in combination with the lower jaw 24 in size and shape to fit into the open end 12 of the caulking gun cartridge nozzle tube 11 for internally supporting the tube 11 on anvil 25 for cutting.

The upper jaw 26 is provided with a V-shaped cutting blade 27 having a depending bottom V-shaped sharp blade edge 28. Cutting blade 27 coacts with anvil 25 for cutting the nozzle tube 11 to form the V-shaped notch 13 illustrated in FIG. 1. The anvil 25 is also V-shaped so that it fits within the inside perimeters of V-shaped cutting blade edge 28. A different type of anvil plate may be provided.

The V-shaped cutting blade 27 is replaceable and is retained on upper jaw 26 by means of removable pin connection 30.

A shear 31 is provided between handles 21 and is adapted for cutting off the caulking gun cartridge nozzle tube tip to provide an open end as illustrated at 12 in FIG. 1.

Shear 31 includes a cutting blade 32 protruding downwardly from upper handle 33 with a sharp distal cutting edge 34 provided at the bottom of blade 32, which protrudes toward the other or lower handle 35. Shear 31 is further provided with a pair of closely spaced parallel guide blades 36 that protrude from the other or lower handle 35 upwardly toward upper handle 33 with the cutting blade edge 34 disposed therebetween so that it is shielded for safety purposes.

Figure 3:
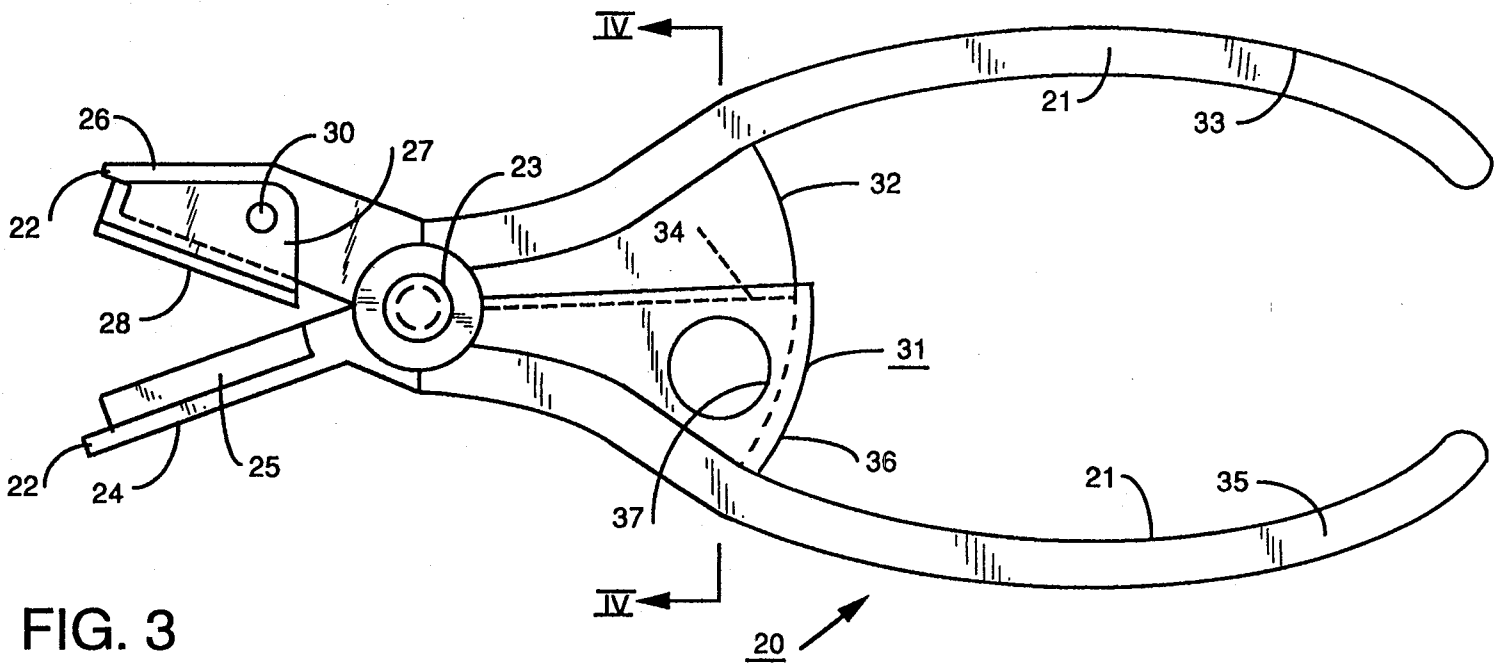
FIG. 3 is a view in side elevation of the hand tool shown in FIG. 1 with the handles and jaws illustrated in the open position.
Figure 6:
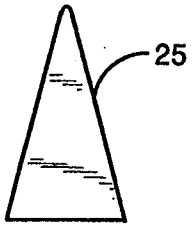
FIG. 6 is a top view of the anvil provided on the lower jaw of the hand tool shown in FIGS. 2 and 3.
Figure 5:
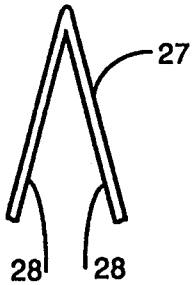
FIG. 5 is a bottom view of the cutting blade portion provided on the upper jaw of the hand tool shown in FIGS. 2 and 3.

Aligned transverse openings 37 are provided in guide blades 36 and adapted when the handles are open as shown in FIG. 3 to receive the tip of nozzle tube 11 therethrough so that the tip may be cut off as illustrated at 12 in FIG. 1 when the handles 21 are squeezed together. The diameter of openings 37 may be regulated to assist in regulating the diameter of cut end 12 of nozzle 11.

I claim:

1. A hand tool for cutting plastic caulking gun cartridge nozzles in preparation for laying a uniform bead of caulk comprising:

a plier-like implement including a pair of coaxial pivotally connected and co-acting handles having coacting die carrying jaws extending beyond the pivotal connections thereof, one of said jaws having a base plate providing an anvil thereon with said jaw and anvil adapted in combination for insertion into an open ended caulking gun cartridge nozzle tube for internally supporting said tube on said anvil for cutting, the other of said jaws having a V-shaped cutting blade coacting with said anvil and adapted for cutting said nozzle tube when disposed on said anvil to form a V-shaped notch with its apex directed away from said nozzle tube open end and its base coinciding with said open end when said handles are coactingly squeezed together, and shear means disposed between said handles and adapted for cutting off a caulking gun cartridge nozzle tube tip to provide said open end.

2. The hand tool of claim 1 wherein said shear means includes a shear cutting blade protruding with a distal cutting edge from one of said handles toward the other of said handles, a closely spaced parallel pair of guide blades protruding from said other handle toward said one handle with said cutting edge disposed therebetween for safety shielding thereof, and aligned transverse openings through said guide blades and adapted when said handles are open for receiving a nozzle tube tip through said openings to be cut off by said shear cutting blade when said handles are squeezed together.

3. The hand tool of claim 2 wherein said V-shaped cutting blade is replaceable.

* * * * *